US008844753B2

(12) United States Patent
Starnes

(10) Patent No.: US 8,844,753 B2
(45) Date of Patent: Sep. 30, 2014

(54) RIGID OUTER CONTAINER FOR ASEPTIC FLUID TRANSPORT

(75) Inventor: Christopher J. Starnes, Camarillo, CA (US)

(73) Assignee: Meissner Filtration Products, Inc., Camarillo, CA (US)

( * ) Notice: Subject to any disclaimer, the term of this patent is extended or adjusted under 35 U.S.C. 154(b) by 0 days.

(21) Appl. No.: 13/425,204

(22) Filed: Mar. 20, 2012

(65) Prior Publication Data

US 2012/0241447 A1 Sep. 27, 2012

Related U.S. Application Data

(60) Provisional application No. 61/454,808, filed on Mar. 21, 2011.

(51) Int. Cl.

*B65D 25/04* (2006.01)
*B65D 77/06* (2006.01)
*B65D 19/18* (2006.01)

(52) U.S. Cl.

CPC ..... *B65D 77/061* (2013.01); *B65D 2519/009* (2013.01); *B65D 2519/00587* (2013.01); *B65D 2519/00069* (2013.01); *B65D 2519/00208* (2013.01); *B65D 2519/00333* (2013.01); *B65D 2519/00174* (2013.01); *B65D 2519/00432* (2013.01); *B65D 19/18* (2013.01); *B65D 2519/00034* (2013.01); *B65D 2519/00711* (2013.01); *B65D 2519/00805* (2013.01); *B65D 2519/00129* (2013.01); *B65D 2519/0081* (2013.01); *B65D 2519/00646* (2013.01)

USPC ..... 220/531; 220/4.28; 206/600

(58) Field of Classification Search

USPC ..... 220/723, 721, 720, 23.91, 495.06, 530, 220/626, 627, 541, 545, 557, 661, 735, 501, 220/520, 495.05, 4.28, 531; 206/572, 577, 206/600

See application file for complete search history.

(56) References Cited

U.S. PATENT DOCUMENTS

| | | | | | |
|---|---|---|---|---|---|
| 3,123,254 | A | * | 3/1964 | Rabby et al. | 222/105 |
| 3,137,415 | A | * | 6/1964 | Faunce | 222/183 |
| 3,212,681 | A | * | 10/1965 | Weikert | 222/183 |
| 4,964,528 | A | * | 10/1990 | Wagoner | 220/551 |
| 5,085,349 | A | * | 2/1992 | Fawcett | 220/703 |
| 5,323,911 | A | * | 6/1994 | Johnston et al. | 206/600 |
| 5,402,915 | A | * | 4/1995 | Hogan | 222/105 |
| 5,419,448 | A | * | 5/1995 | Watson | 220/4.28 |
| 5,622,276 | A | * | 4/1997 | Simmons | 220/6 |
| 5,826,752 | A | * | 10/1998 | Latimer | 222/105 |
| 6,520,364 | B2 | * | 2/2003 | Spykerman et al. | 220/6 |
| 6,533,122 | B1 | * | 3/2003 | Plunkett | 206/600 |
| 6,543,495 | B2 | * | 4/2003 | Hougland | 141/234 |

(Continued)

*Primary Examiner* — Anthony Stashick
*Assistant Examiner* — Mollie Llewellyn
(74) *Attorney, Agent, or Firm* — Christie, Parker & Hale, LLP

(57) ABSTRACT

The present invention relates to the storage and transportation of fluids, and more particularly to a rigid outer container for aseptic transport of pharmaceutical fluids. In one embodiment, a system for aseptic storage and/or transport of a fluid includes a rigid outer container including a front wall and a back wall, a main cavity inside the outer container, and an inner wall dividing the main cavity into first and second compartments. The first compartment is located between the front wall and the inner wall, and the second compartment is located between the inner wall and the back wall. The second compartment may carry a biocontainer, and ancillary equipment for the biocontainer may be stored in the first compartment.

26 Claims, 11 Drawing Sheets

(56) References Cited

U.S. PATENT DOCUMENTS 6,955,273 B2 * 10/2005 Hartwall ..... 220/1.6
7,210,594 B2 * 5/2007 Schutz ..... 220/1.6
2007/0145051 A1 * 6/2007 Uffner et al. ..... 220/4.28
2008/0029517 A1 * 2/2008 Briers ..... 220/495.01

* cited by examiner

RIGID OUTER CONTAINER FOR ASEPTIC FLUID TRANSPORT

CROSS-REFERENCE TO RELATED APPLICATION(S)

This Patent Application claims the benefit of U.S. Provisional Patent Application Ser. No. 61/454,808, filed on Mar. 21, 2011, the entire contents of which are hereby expressly incorporated by reference.

FIELD OF THE INVENTION

The present invention relates to the transportation of fluids, and more particularly to a rigid outer container for aseptic storage and/or transport of pharmaceutical fluids.

BACKGROUND

In the pharmaceutical industry, various types of fluids are used for the preparation, testing, and storage of pharmaceutical compositions, including drugs, drug components, cleaning solutions, and other fluids. These fluids often need to be safely transported between locations. Additionally, it is often important to maintain the sterility of these fluids before, during, and after transport. Due to sterility requirements, shipping containers for these fluids are often accompanied by various connectors, tubes, and filters that enable aseptic processing of the fluid.

Existing systems for transporting such fluids include a flexible inner container which holds the fluid (referred to as a biocontainer), such as a flexible bag, and an outer rigid container that supports and protects the biocontainer. The biocontainer is connected to tubing for filling, draining, and accessing the fluid. Other equipment may be connected to the biocontainer and the tubing, such as filters, pumps, and connectors that enable aseptic processing of the fluid. The tubing and connectors maintain a sterile fluid path for fluid access and enable sterile connections even in a non-sterile environment.

The tubing, connectors, filters, pumps, and other ancillary equipment are often shipped with the biocontainer for use in draining or accessing the fluid when it reaches its destination. Once the biocontainer is drained, the entire assembly may be shipped back to the initial location for re-use.

Therefore, there is a need to provide an outer container that can support the filled biocontainer as well as the ancillary equipment that enables aseptic processing of the fluid. There is also a need for a container that has compact outer dimensions and that minimizes the space occupied by the empty container during return shipping.

SUMMARY

The present invention relates to the transportation of fluids, and more particularly to a rigid outer container for aseptic transport of pharmaceutical fluids. In one embodiment, the container includes a base, a perimeter wall, and a lid, enclosing a main cavity. Additionally, an inner wall is provided within the cavity, dividing the cavity into first and second compartments. The biocontainer that carries the fluid is located in the second compartment, behind the inner wall. The first compartment on the opposite side of the inner wall provides access and storage space for ancillary equipment that accompanies the biocontainer—such as connectors, tubing, and filters that enable aseptic processing of the fluid inside the biocontainer. This equipment may be stored in the first compartment, and can be connected to the biocontainer through openings in the inner wall. In one embodiment, the inner wall can be folded into a storage position when the container is not in use, to minimize the space occupied by the empty container during return shipping. In particular, the perimeter walls can be folded toward the base, and stowed between the base and the lid for shipment. The walls can also be removed for service or replacement. In one embodiment, the inner wall is pivotably attached to the front wall to facilitate the movement of the inner wall and front wall into the collapsed, stowed position. In this stowed position, the biocontainer is compact and occupies less space than a deployed container for return shipping. After return shipping, the container can be reassembled for shipment of a new filled biocontainer, with the inner wall deployed to create the separate compartments and provide easy access to both the biocontainer and the ancillary equipment.

In one embodiment, a system for aseptic storage or transportation of a fluid includes a rigid outer container for transport of a fluid in a biocontainer. The rigid outer container includes a front wall, a back wall, and a main cavity inside the outer container. An inner wall is provided to divide the main cavity into two compartments. The first compartment is located between the front wall and the inner wall, and the second compartment is located between the inner wall and the back wall. The rigid outer container may be used to transport a filled biocontainer in the second compartment.

In one embodiment, a container for aseptic storage or transportation of a fluid is provided. The container includes a base and a perimeter wall connected to the base. A lid is attachable to the perimeter wall. The base includes a floor, and the floor, the perimeter wall, and the lid define a cavity. An inner wall is provided to divide the cavity into two compartments. The inner wall extends upright, such that each compartment extends between the floor and the lid. A biocontainer may be supported in the second compartment, behind the first compartment.

In one embodiment, a method for aseptic storage or transportation of a fluid is provided. The method includes providing a rigid outer container, which has a base and a perimeter wall. The base and perimeter wall define a cavity. The method also includes dividing the cavity into first and second compartments. The first compartment is located between the second compartment and the front end of the container. The method also includes supporting a biocontainer in the second compartment, and storing ancillary equipment for the biocontainer in the first compartment. According to particular end-use needs, the method may also include filling the biocontainer with a fluid, and accessing the biocontainer through the first compartment.

DETAILED DESCRIPTION

Figure 1:
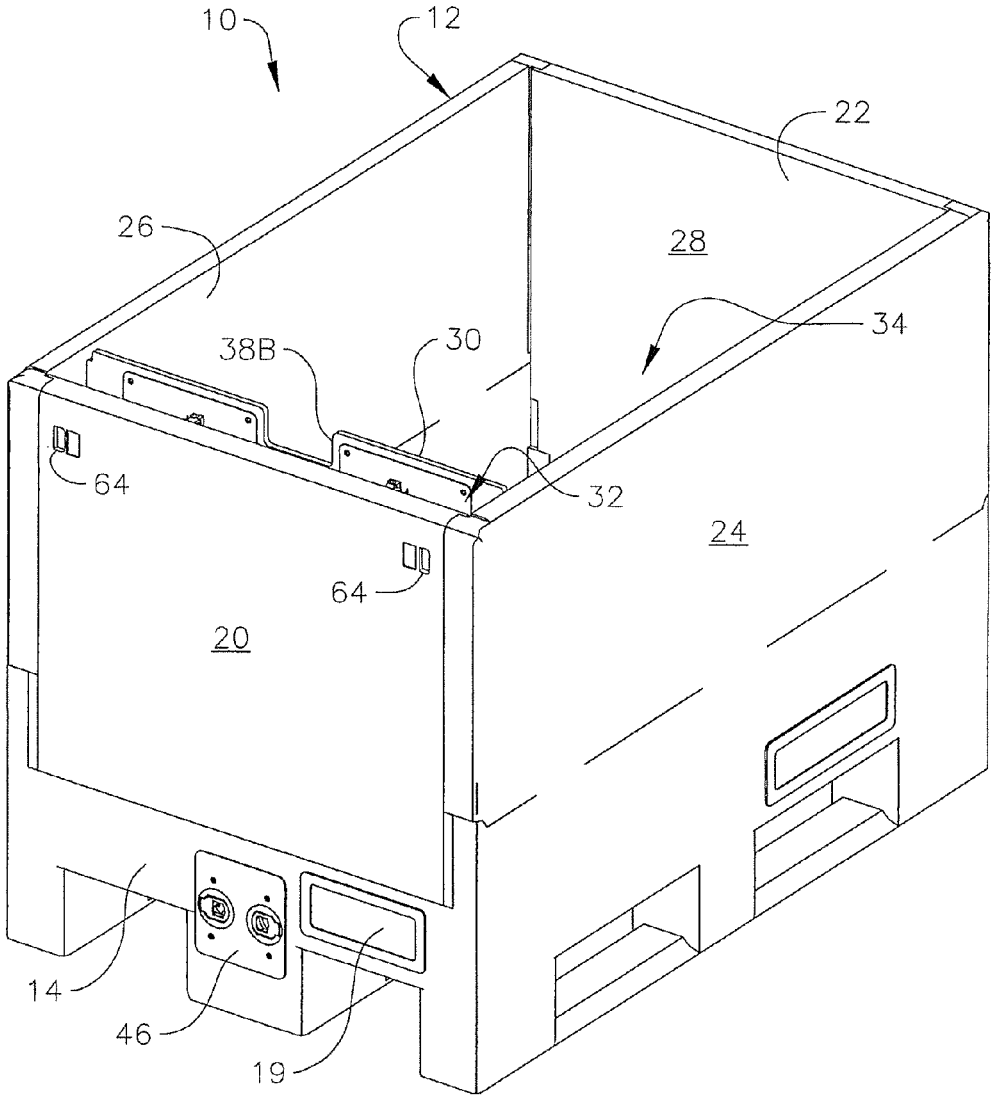
FIG. 1 is a front perspective view of a container in a deployed position, with the lid removed, according to an embodiment of the present disclosure.

The present invention relates to the transportation of fluids, and more particularly to a rigid outer container for aseptic transport of pharmaceutical fluids. In one embodiment, the container includes a base, a perimeter wall, and a lid, enclosing a main cavity. Additionally, an inner wall is provided within the cavity, dividing the cavity into first and second compartments. The biocontainer that carries the fluid is located in the second compartment, behind the inner wall. The first compartment on the opposite side of the inner wall provides access and storage space for ancillary equipment that accompanies the biocontainer—such as connectors, tubing, and filters that enable aseptic processing of the fluid inside the biocontainer. This equipment may be stored in the first compartment, and can be connected to the biocontainer through openings in the inner wall. In one embodiment, the inner wall can be folded into a storage position when the container is not in use, to minimize the space occupied by the empty container during return shipping. In particular, the perimeter walls can be folded toward the base, and stowed between the base and the lid for shipment. In one embodiment, the inner wall is pivotably attached to the front wall to facilitate the movement of the inner wall and front wall into the collapsed, stowed position. In this stowed position, the biocontainer is compact and occupies less space than a deployed container for return shipping. After return shipping, the container can be redeployed for shipment of a new filled biocontainer, with the inner wall deployed to create the separate compartments and provide easy access to both the biocontainer and the ancillary equipment.

It should be noted that the terms front, back, top, bottom, side, and other similar terms are relative terms only, used for convenience to describe relative locations of components, and are not intended to be limiting in an absolute sense.

A container 10 for aseptic storage and/or transport of a fluid, according to an embodiment, is shown in FIGS. 1, 1A, 1B, and 2. The container 10 is shown in the deployed position in FIG. 1, and in the stowed or collapsed position in FIG. 2. The container 10 includes a perimeter wall 12, a base 14, and a lid 16. The top surface of the base 14 forms an interior floor 18 for the container (see FIG. 1A). The base 14 may also include a label 19 for identification of the container and the fluid inside. The perimeter wall 12 includes a front wall 20, back wall 22, and two side walls 24, 26. These walls are attachable to the base 14 at the lower end of each wall, and to the lid 16 at the upper end of each wall. In the deployed position, shown in FIG. 1, the walls define a cavity 28 inside the walls and between the floor 18 and the lid 16. The lid 16 is removed in FIG. 1 for clarity. As explained in further detail below, the main cavity 28 carries the biocontainer with the fluid and the ancillary equipment for accessing the fluid.

Figure 2:
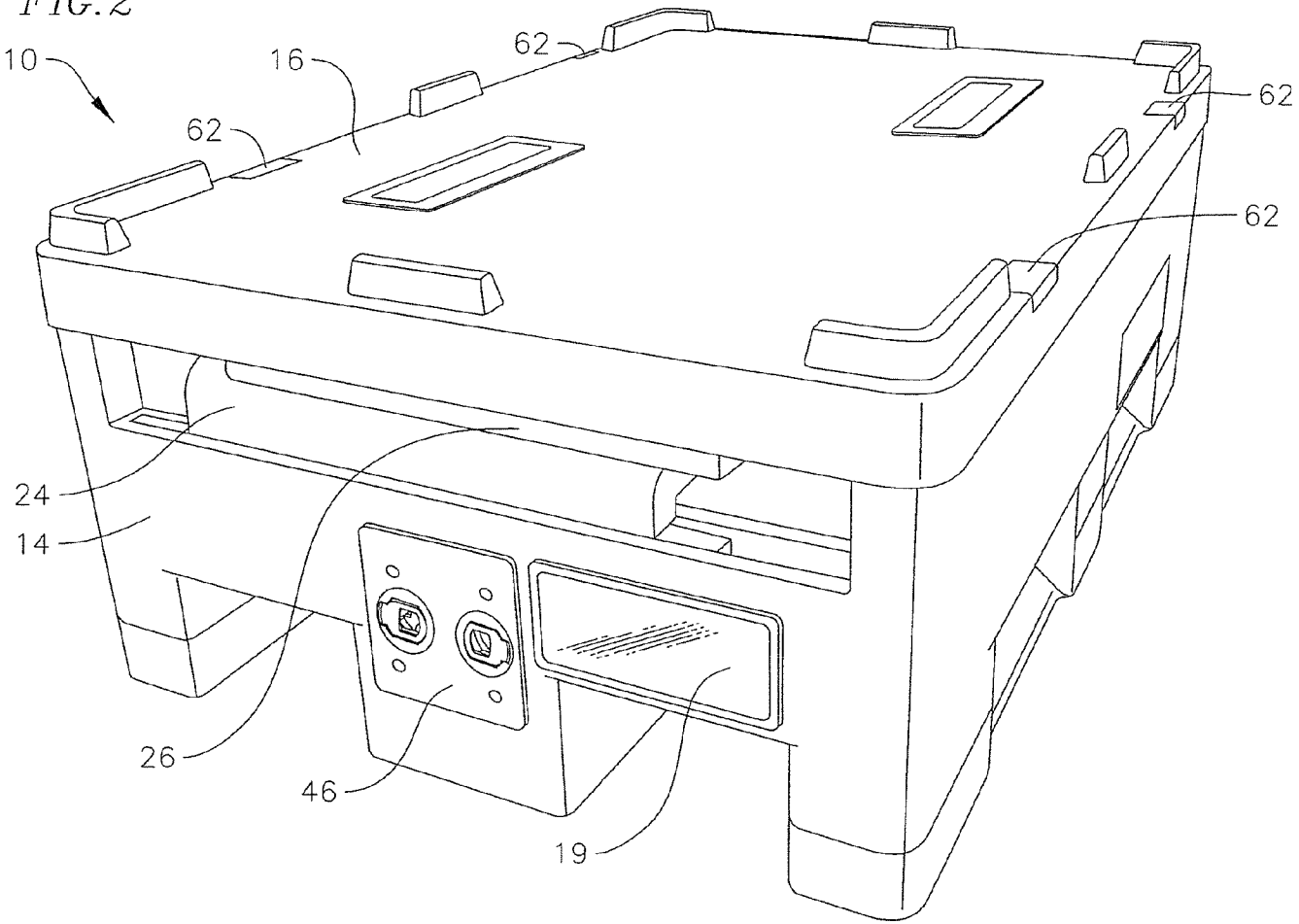
FIG. 2 is a front perspective view of a container in a stored position, according to an embodiment of the present disclosure.

In the stowed position shown in FIG. 2, the walls are collapsed and folded toward the base 14 for storage, to reduce the volume occupied by the empty container. The lid 16 can be attached above the walls to secure them between the lid and the base for return shipping after the fluid has been shipped to its destination and emptied from the container. This stowed configuration reduces the volume occupied by the empty container during return shipping. The stowed configuration of the walls is described in more detail below.

In one embodiment, the container 10 includes an inner wall or partition 30 inside the main cavity 28, when the container is in the deployed position. A top view of the container with the inner wall 30 deployed is shown in FIG. 1A. The walls 20, 22, 24, 26 are upright and connected to the base, forming the perimeter wall 12 around the main cavity 28. The inner wall 30 extends between the two side walls 24, 26, dividing the main cavity 28 into first and second compartments. The first compartment 32 is located in front of the inner wall 30, between the inner wall and the front wall 20. The second compartment 34 is located behind the inner wall 30, between the inner wall and the back wall 22. The inner wall 30 acts as a false wall, creating a side compartment between it and the front wall 20 of the container.

In one embodiment, the second compartment is larger than the first compartment, and is designed to carry and support the biocontainer filled with the fluid. An empty biocontainer 36 is shown in FIG. 1A in the second compartment 34. The biocontainer 36 may be, for example, a flexible bag that can be filled with the desired amount of fluid. The back wall 22, side walls 24 and 26, and inner wall 30 support the filled biocontainer 36 in the second compartment 34 and protect the biocontainer from pressure or puncture during shipment. As explained in more detail below, the inner wall 30 is latched and locked into its upright position so that it can securely retain the biocontainer 36 safely in the second compartment 34 behind the first compartment 32.

The first compartment 32 provides available space for ancillary equipment that is shipped with the biocontainer and facilitates access to the biocontainer for filling, draining, sampling, or other activities. Tubing that connects to the biocontainer 36 can be passed through one or more openings 38A, 38B in the inner wall 30 and into this first compartment 32, where the tubing can be more easily accessed, organized, and stored. In one embodiment, the inner wall 30 includes a first opening 38A near the floor 18 of the container, and a second opening 38B near the lid (also shown in FIG. 6). These openings are conveniently located for tubing that connects to the top and bottom of the biocontainer. For example, tubing connected to a port at the top of the biocontainer can be passed through opening 38B to fill or drain the biocontainer. Tubing connected to a port at the bottom of the biocontainer can be passed through opening 38A to fill or drain the biocontainer. The compartment 32 enables tubing and connectors that are sterilized with the biocontainer 36 to be shipped with the biocontainer, preserving the sterile path from the biocontainer to the end connector. The biocontainer, tubing, and connectors may all be sterilized prior to assembly in the container 10, such as by gamma radiation. Extra length of sterile tubing can be stored in the compartment 32, and can then be used to make the necessary connections to drain or access the fluid, without compromising the sterile envelope.

Figure 1A:
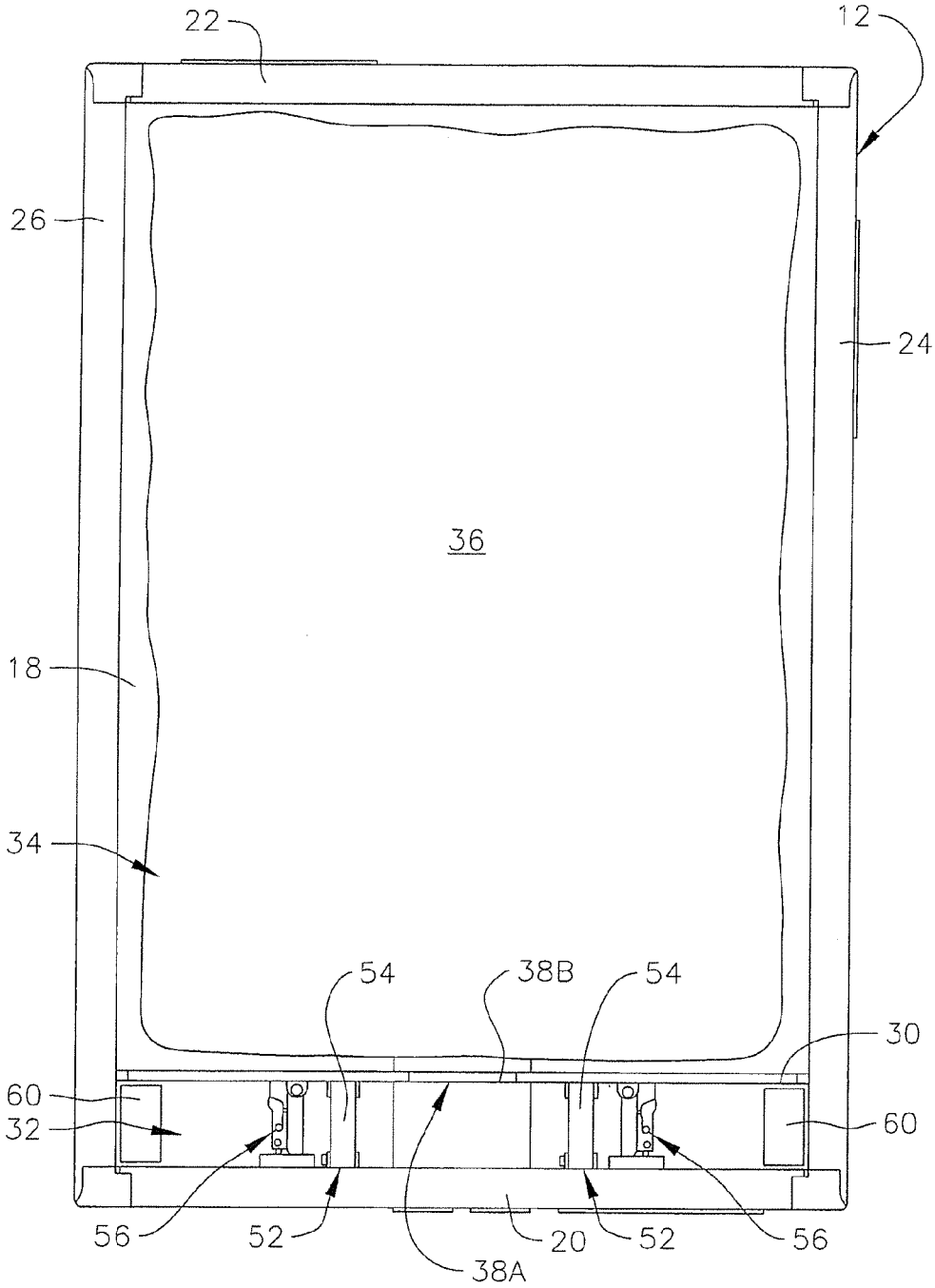
FIG. 1A is a top view of the container of FIG. 1, with an empty biocontainer inside the container.
Figure 1B:
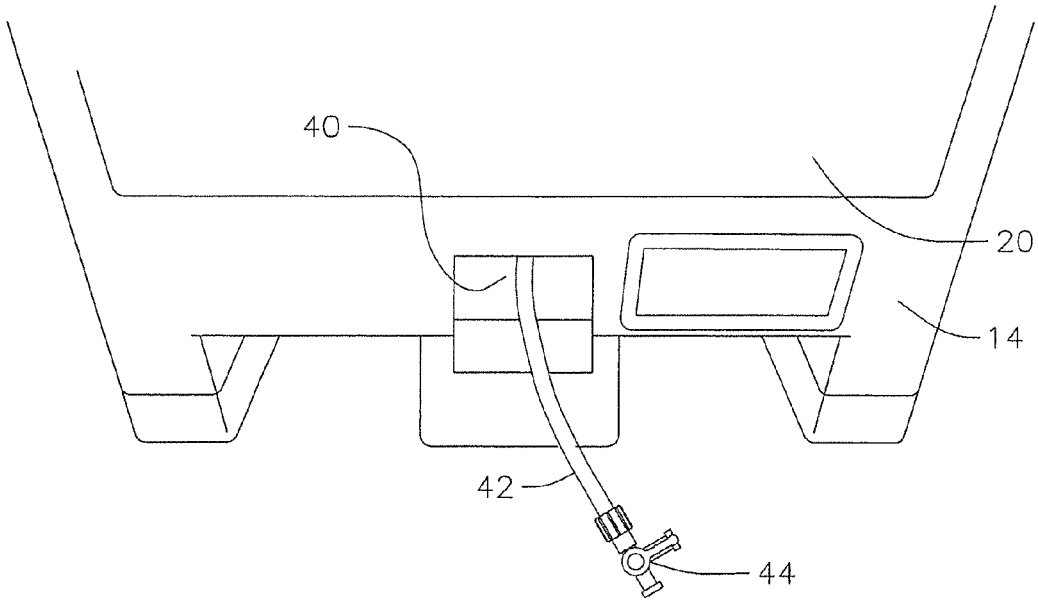
FIG. 1B is a partial front view of the container of FIG. 1, with the front access hatch removed.

A drain 40 may be provided in the base 14, as shown in FIG. 1B, for access to the fluid in the biocontainer via tubing 42 extending from the first compartment 32. The tubing 42 is shown with a connector 44 at the end, which may be an aseptic connector for aseptic access to the fluid inside the biocontainer 36. The drain 40 may be covered by a removable access hatch 46 when the drain is not in use (see FIG. 1).

As shown in FIGS. 1 and 1A, the first and second compartments 32, 34 are located side by side in the main cavity 28, each compartment extending between the floor 18 and the lid 16. This design positions the biocontainer and the ancillary equipment next to each other, rather than above or below each other. The first compartment 32 is adjacent the compartment that houses the fluid (the second compartment 34). In one embodiment, the first compartment 32 is positioned between the fluid and the drain 40. The inner wall 30 partitions the cavity 28 such that the first compartment is between the inner wall 30 and the front wall 20, and the second compartment is behind the first compartment, between the inner wall and the back wall 22. The lid 16 extends over both compartments to close the container 10. The lid may include latches 62 or other mating features to lock the lid to the container for security (FIG. 2).

Due to the side-by-side arrangement of the compartments, the first compartment provides access to the biocontainer at both the top and the bottom of the biocontainer. As shown in FIG. 1A (also shown in FIG. 6), the inner wall 30 has openings 38A, 38B at both the bottom and top of the wall, providing a pass-through for tubing or other equipment at both the top and the bottom of the second compartment. Thus the fluid in the biocontainer can be easily accessed at both the top and bottom of the biocontainer. This provides flexibility in the choice of biocontainer, and can accommodate biocontainers with ports at the top and/or at the bottom of the biocontainer. For example, a biocontainer with an access port at the top of the biocontainer can be accessed easily through the opening 38B, instead of requiring tubing to run between the biocontainer and the side walls or front wall toward the bottom drain 40.

Passing the tubing through the inner wall 30 and into the first compartment 32 not only keeps the tubing organized and easy to access, but also protects the biocontainer 36, as the tubing is not routed along the inside walls of the second compartment 34. If the tubing is routed between the biocontainer and the walls of the container, the tubing can press against the biocontainer, which can create a risk of puncturing or snagging the biocontainer, or tangling or collapsing the tubing.

Figure 3:
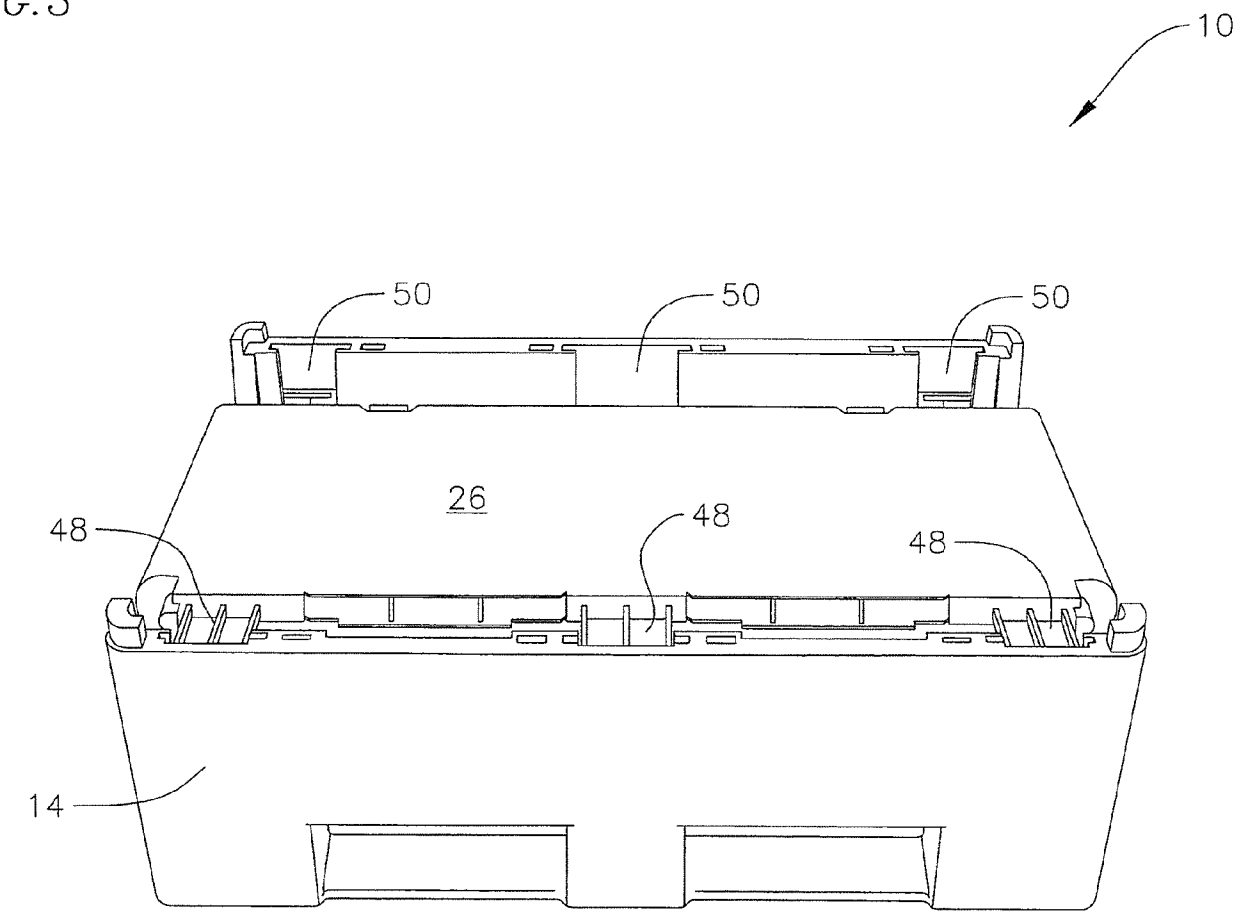
FIGS. 3-6 show side views of a container in stages of deployment, according to an embodiment of the present disclosure.

The collapsible design of the container 10 and the method for deploying or collapsing the container is shown in FIGS. 3-6. In FIG. 3, the container 10 is shown in the stowed or collapsed position, with the perimeter wall 12 collapsed and stacked on the base 14. The lid 16 has been removed, and the side wall 26 is visible at the top of the stack of walls. The other side wall 24 as well as the front wall 20, back wall 22, and inner wall 30 are below the side wall 26, between the side wall 26 and the floor 18 of the base 14.

Figure 4:
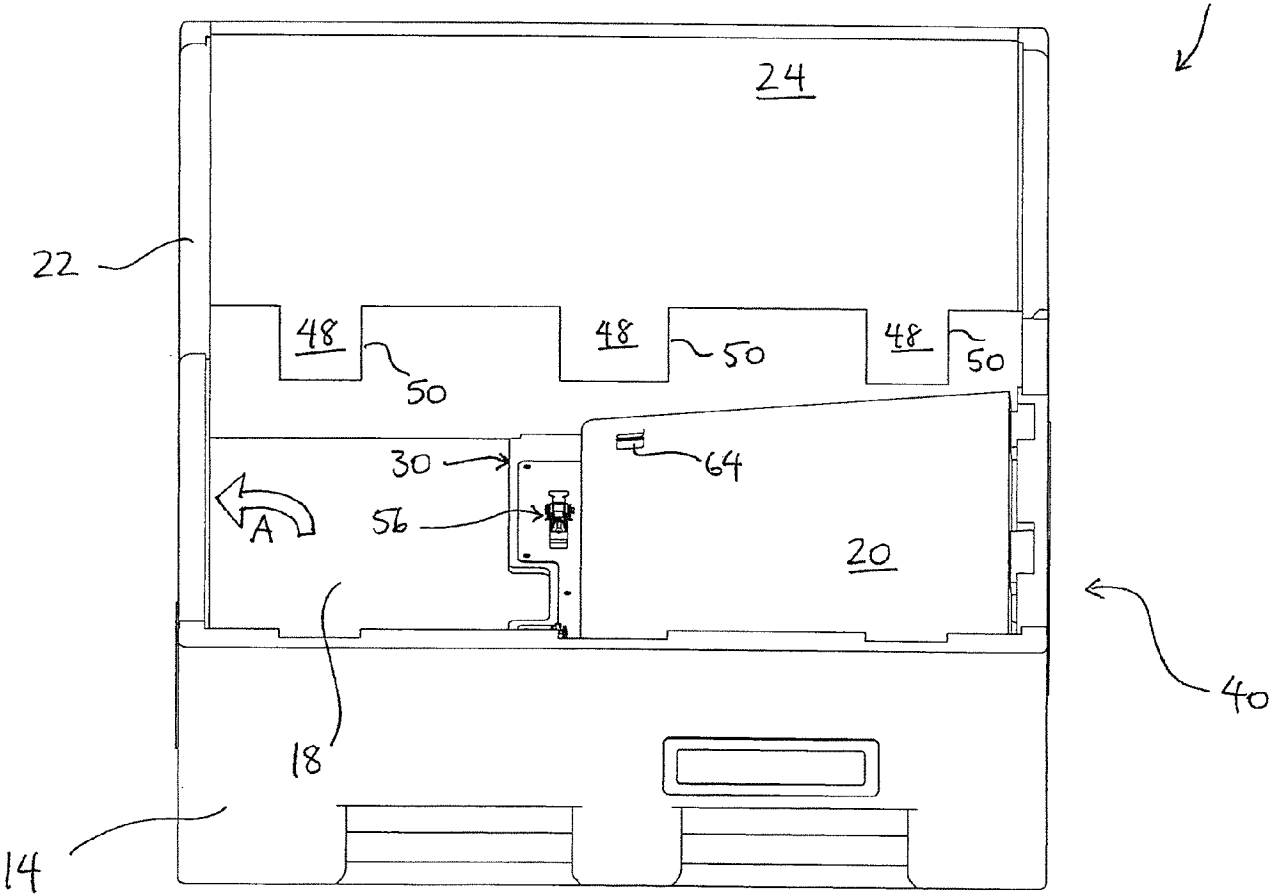

As shown in FIG. 3, the side wall 26 includes three legs 48 extending from the bottom end of the wall, and sized to fit into corresponding slots 50 along the base 14. Each wall 20, 22, 24, 26 includes legs that fit into corresponding slots. The mating of the legs 48 into the slots 50 is shown in FIG. 4. When the stowed container 10 of FIG. 3 is ready to be used, the lid is removed, and the walls are lifted from their stacked, stowed position. Each wall is rotated into an upright position, and the legs 48 fit into the slots 50 to lock each wall into place.

In FIG. 4, the left side wall 26 has been removed from the stack and is not pictured, for clarity. Each wall can be completely removed from the base. The right side wall 24 has been rotated upright, with the legs 48 engaging the slots 50 to lock the wall 24 to the base 14. FIG. 4 shows the rotation of the back wall 22 into its deployed position. While stored, the back wall 22 overlaps the front wall 20 and the inner wall 30, as indicated by the dotted lines. The arrow A shows the direction of movement of the back wall 22 into its deployed, upright position.

The front and back walls 20, 22 have locking features such as latches 64 that engage the side walls 24, 26 when the walls are in the upright position. In one embodiment, the latches resemble door latches, with an extension from the front and back walls 20, 22 entering a corresponding recess in the side walls 24, 26. The latches 64 can be operated, such as slid inward, to release the front and back walls 20, 22 from the side walls and enable the walls to fold down.

Figure 5:
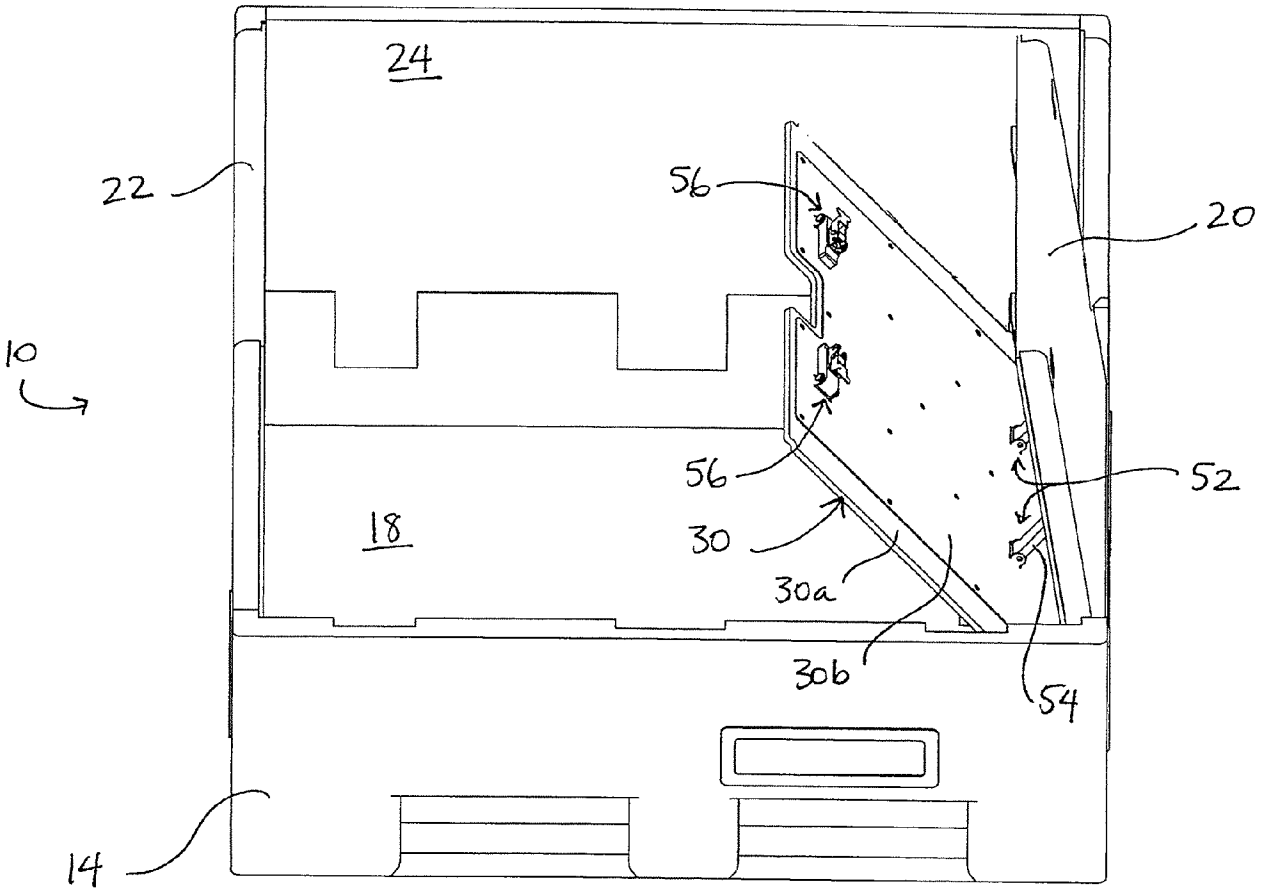

The front wall 20 and inner wall 30 are the last components deployed, and the first stored, at the bottom of the stack of walls. FIG. 5 shows the rotation of the front wall 20 from its stowed position (from FIG. 4) into its upright, deployed position. In the embodiment shown, the inner wall 30 is coupled to the front wall 20 for deployment along with the front wall. To explain the combined deployment of the front wall 20 and inner wall 30 and the adjustment of the inner wall 30 into its final, locked position, the connection between the front wall 20 and inner wall 30 is next described.

In one embodiment, the inner wall 30 is connected to the front wall 20 by a pivot joint 52, which enables the inner wall to pivot with respect to the front wall for storage. In the embodiment shown, two pivot joints 52 are provided between the inner wall 30 and the front wall 20 (see FIGS. 1A, 5, 6). Each pivot joint 52 includes a pivot arm 54 hingedly connected at a first end to the front wall and at a second end to the inner wall. Both ends of the arm 54 are hinged to allow for rotation of each wall about the arm. The arm 54 can be hinged by passing a pin through the ends of the arm and through corresponding rings or passages attached to each wall, in order to hingedly attach the arm to each wall. The walls are connected together by this pivot joint 52 in both the deployed and stowed positions. In the stowed position (FIG. 4), the pivot arm 54 has rotated about its hinged ends until both walls are substantially adjacent, with the front wall 20 positioned above the inner wall 30. The pivot arm 54 is rotated to lay flat between the two walls. As the front wall 20 is lifted (FIG. 5), the pivot arm 54 rotates about its hinged ends, separating the two walls. In the deployed position (FIG. 6), the pivot arm 54 has rotated about its hinged ends until the two walls 20, 30 are facing each other, with the pivot arm 54 extending between them.

Figure 6:
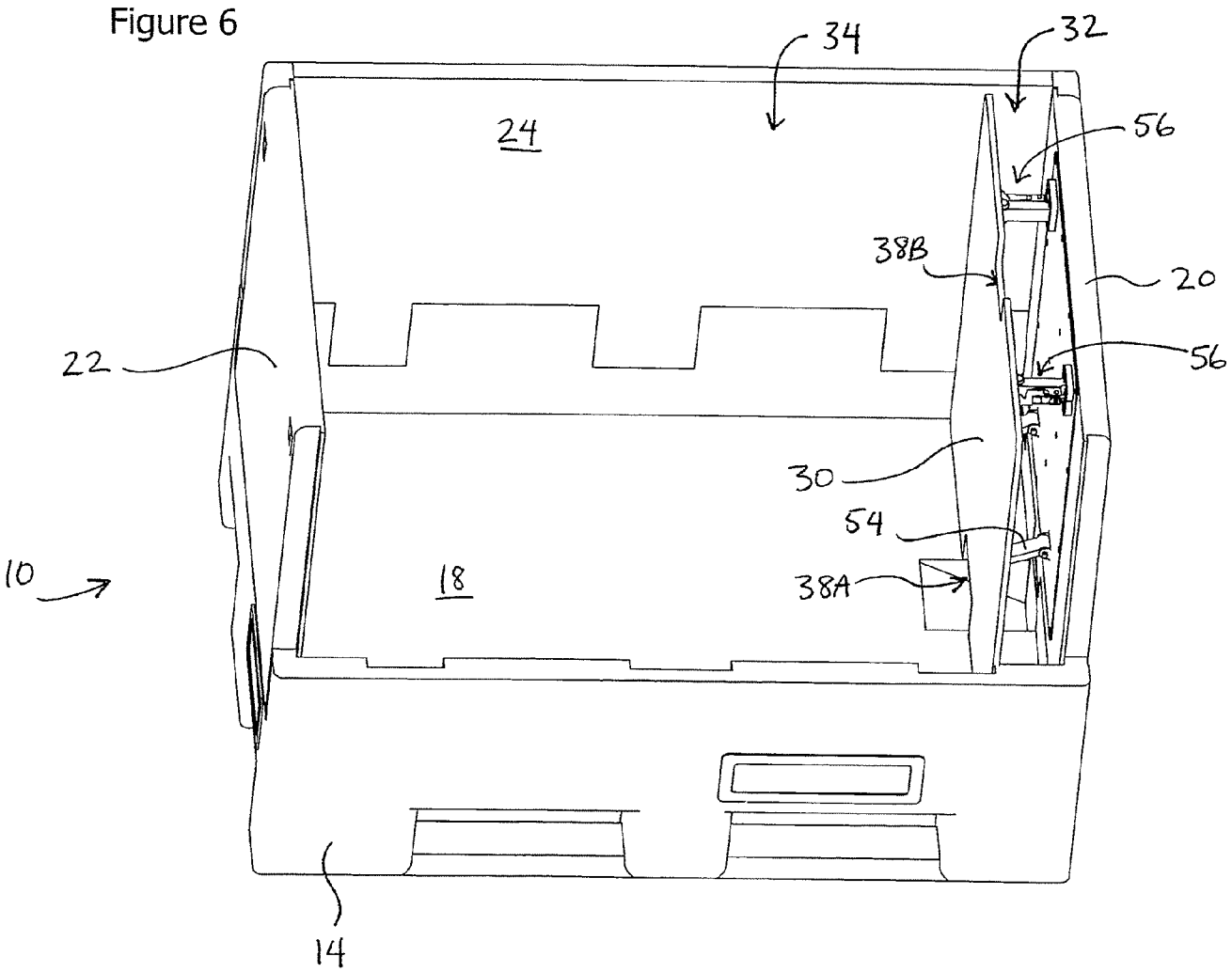
Figure 7A:
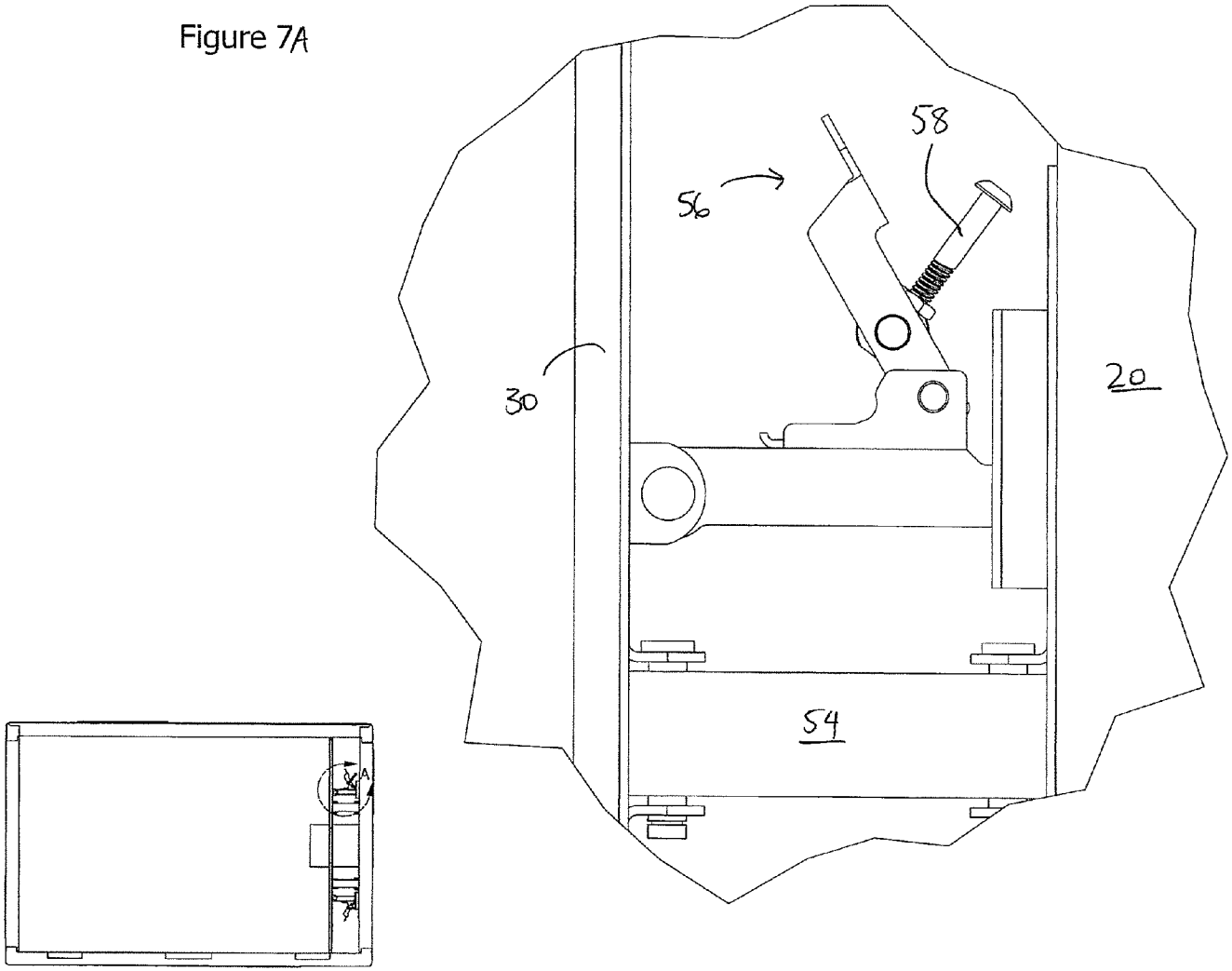
FIGS. 7A-C show a latch in stages of deployment, according to an embodiment of the present disclosure.
Figure 7B:
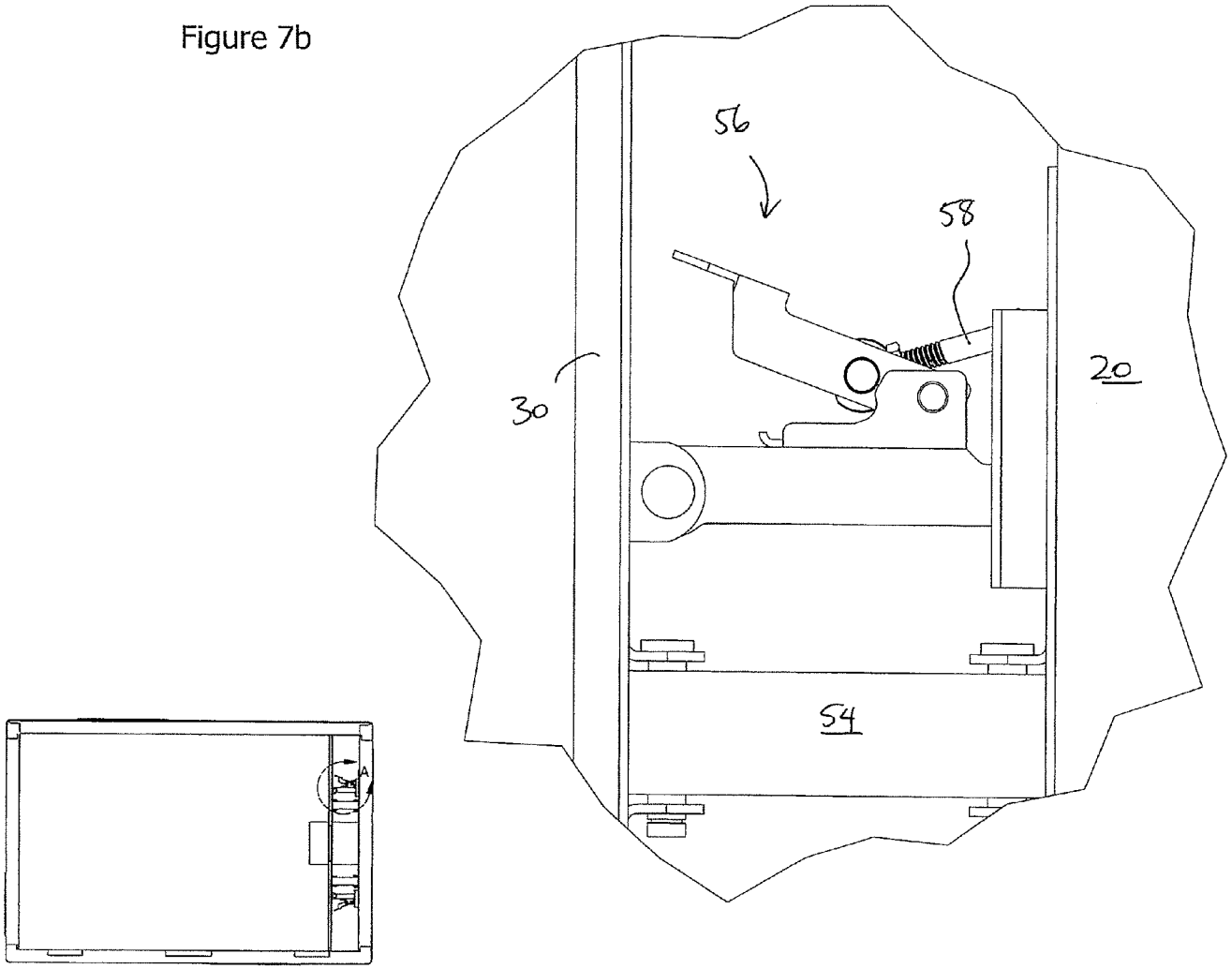
Figure 7C:
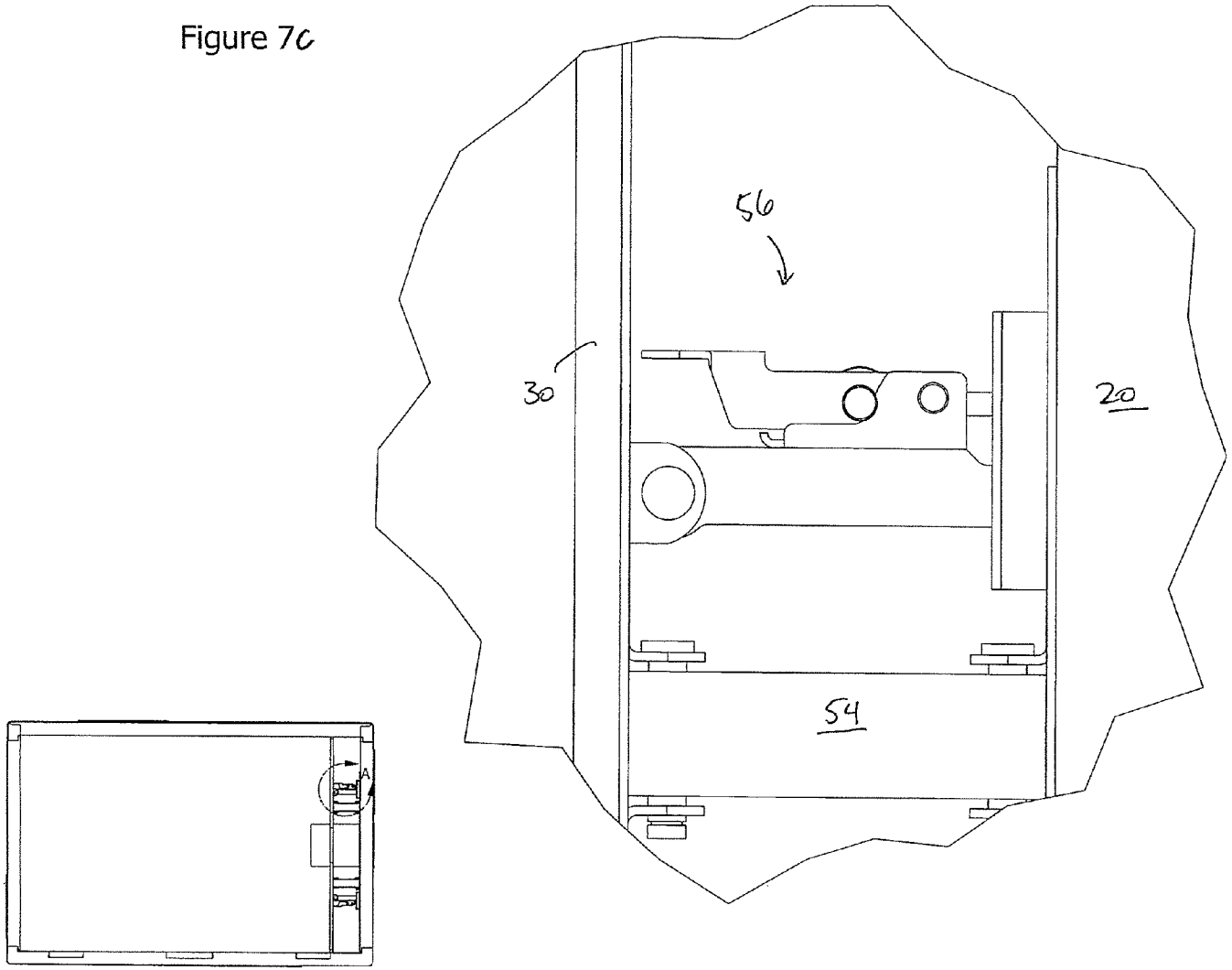

Once the inner wall 30 is rotated into this deployed position (FIG. 6), it is locked into this position by one or more latches 56. In the embodiment shown, two latches 56 are provided. The latches are engaged and locked after the inner wall 30 is moved into its deployed position as shown in FIG. 6. An enlarged view of the latch 56 is shown in FIG. 7. The latch 56 is engaged by moving a pin 58 into a corresponding slot and then rotating the latch to lock the pin in place. The latch 56 locks the inner wall 30 behind the front wall 20, spaced apart by the pivot arm 54 and the latch 56, forming the first compartment 32 between the inner wall 30 and the front wall 20.

The pivot arms 54 are sized to be the appropriate length to pivot the inner wall 30 forward so that the latches 56 clear the top of the front wall 20 in the stowed position, as shown in FIG. 4. Thus, when the front wall 20 and inner wall 30 are folded down to the position shown in FIG. 4, the pivot arms 54 rotate about their hinged ends to move the inner wall 30 beyond the top of the front wall 20 so that the front wall 20 can lay flat on the inner wall 30, next to the latches 56. In one embodiment, when the front wall 20 and inner wall 30 are rotated up into their upright position, the pivot arms 54 rotate beyond 90° to their final position, pointing upward toward the front wall 20. The latches 56 are then engaged as described above.

The length of the latches 56 can be selected according to the desired size of the first compartment 32. In one embodiment, the distance between the inner wall 30 and the front wall 20 is about 3.25 inches. This dimension is chosen to provide the desired storage volume in the first compartment 32. In one embodiment, stop blocks 60 are provided on the floor 18 of the base 14 to abut the inner wall 30 in its deployed position (see FIG. 1A). The lower end of the inner wall 30 rests against these stop blocks 60, which support the inner wall 30 from moving inward toward the front wall 20 due to the pressure of a filled biocontainer inside the second compartment 34. The stop blocks may be plastic pieces attached such as by glue or mechanical fasteners to the floor 18.

In one embodiment, the inner wall 30 is formed from a plastic panel 30*a* and a reinforcing metal plate 30*b*, as shown in FIG. 5. The rigid plastic panel 30*a* extends to the full dimensions of the inner wall. The material is selected to be able to withstand high and low temperatures during shipping, such as during summer or winter months in shipping trucks. The plastic materials also are lightweight, do not rust, and are easily sanitized.

The metal plate 30*b* is attached to the plastic panel 30*a* on the surface of the panel facing the front wall 20, facing into the first compartment 32. The metal plate 30*b* reinforces the inner wall and provides a mounting surface for attachment of the latches 56 and pivot joints 52. In one embodiment, the metal plate is a stainless steel material, and it may have a mirrored finish. A mirrored metal plate may also be attached to the inside surface of the front wall 20, so that the two mirrored plates face each other, providing additional light in the first compartment 32. In one embodiment, the metal plate attached to the inner wall is about 0.050 inches in thickness, and the plastic panel is about ⅜ inch thick. The dimensions are chosen such that the inner wall 30 is thick enough to have the strength to withstand pressure from a filled biocontainer in the second compartment, but also thin enough to fold down and lay flat under the front wall 20 for storage.

To collapse the container 30 into its compact, stowed configuration (shown in FIG. 2), the process above is reversed. The latches 56 are released, enabling the inner wall 30 to pivot about the pivot arm 54 of the pivot joint 52. The latches 64 are released, and the front wall 20 is then rotated down toward the floor 18. As the front wall 20 moves down, the inner wall 30 pivots about pivot arm 54 until both walls 20, 30 lay stacked against the floor 18 (see FIG. 4). The other walls 22, 24, 26 are then rotated down and stacked above the front wall 20 and inner wall 30, as shown in FIGS. 3 and 4. The lid 16 can then be attached above the stacked walls to secure them in the stowed position (FIG. 2).

In one embodiment, a method for aseptic storage or transport of a fluid includes providing a rigid outer container such as the container 10. The container has a base and a perimeter wall defining a cavity, and has a front end with a drain. The method includes dividing the cavity into first and second compartments, the first compartment being between the second compartment and the front end of the container. The method also includes supporting a biocontainer in the second compartment, and placing ancillary equipment for the biocontainer in the first compartment. Examples of the ancillary equipment include tubing, connectors, filters, pumps, ports, plugs, and other equipment used to access, sample, drain, or fill the biocontainer. The method may also include filling the biocontainer with a fluid. The method may also include accessing the biocontainer from the first compartment, such as via tubing, connectors, or other mechanisms that pass into or through the first compartment to the biocontainer. In one example, access to the biocontainer is provided by tubing that passes from a port in the biocontainer through an opening in the inner wall, through the first compartment, and out the drain.

In one embodiment, an inner wall or partition is provided to divide the cavity into the first and second compartments. The inner wall is connected to the perimeter wall. For example, the inner wall may be pivoted from a stowed position into a deployed position and then latched to the perimeter wall.

In one embodiment, the interior dimensions of the cavity 28 are about 102×72 cm (40×28 inches), which is sized for a 500 L biocontainer. In other embodiments, the container 10 is sized for a biocontainer with a total volume of 100 L, 250 L, 1,000 L, or 2,000 L. In general the range of volumes of the biocontainer may be between about 100 L to about 2,000 L. In one embodiment, the volume of the biocontainer is about 500 L, or about 1,000 L, or between about 500-1,000 L. The containers for these volumes have approximately the same aspect ratios as the 500 L container. In one embodiment, the biocontainer 36 is dimensioned to fit inside the second compartment 34, extending between the side walls 24, 26 and between the inner wall 30 and the back wall 22. The biocontainer may also be provided with ports at the top and/or bottom that are aligned with the openings 38A, 38B in the inner wall 30 for easy access.

In one embodiment, the container 10 is made from a suitable rigid plastic material, such as ABS (acrylonitrile butadiene styrene) polystyrene, glass-filled nylon, or polypropylene. The container 10 may be sanitized prior to use and between uses.

Although the present invention has been described and illustrated in respect to exemplary embodiments, it is to be understood that it is not to be so limited, since changes and modifications may be made therein which are within the full intended scope of this invention as hereinafter claimed.

What is claimed is:

1. A system for aseptic storage or transportation of a fluid, comprising:

a rigid container including a first wall, a second wall, and a floor;

a cavity inside the container; and an inner wall dividing the cavity into a first compartment and a second compartment for receiving a biocontainer, with the first compartment between the first wall and the inner wall, and the second compartment between the inner wall and the second wall;

wherein the inner wall is pivotably connected to the first wall by a pivot arm, wherein said inner wall is rotatable relative to the first wall and comprises an opening for access to the biocontainer from the first compartment.

2. The system of claim 1, wherein the first wall and the inner wall are rotatable toward the floor into a stowed position in which the first wall covers at least a portion of the inner wall.

3. The system of claim 1, wherein the inner wall comprises a metal plate attached to a plastic panel.

4. A container for aseptic storage or transportation of a fluid, comprising:

a base defining a floor;

a perimeter wall coupled to the base;

a lid attachable to the perimeter wall, wherein the floor, and the perimeter wall define a cavity;

an inner wall dividing the cavity into first and second compartments, each compartment extending between the floor and the lid, wherein the first compartment extends between the inner wall and a section of the perimeter wall; and a pivot joint coupled between the inner wall and the section of the perimeter wall, wherein the inner wall is rotatable with respect to the section of the perimeter wall about the pivot joint, wherein the inner wall is rotatable about said pivot joint about a first axis with respect to the base, wherein the section of the perimeter wall is rotatable about a second axis with respect to the base to a stowed position over the floor of the base, and wherein when in the stowed position, the inner wall and the section of the perimeter wall form a stack over the floor of the base.

5. The container of claim 4, further comprising tubing stored in the first compartment.

6. The container of claim 5, further comprising a biocontainer located in the second compartment.

7. The container of claim 6, wherein the tubing passes through an opening in the inner wall to connect to the biocontainer.

8. The container of claim 4, further comprising a latch between the inner wall and the perimeter wall to lock the inner wall into a deployed position.

9. The container of claim 4, wherein the base comprises a drain opening communicating with the first compartment.

10. The container of claim 4, wherein the perimeter wall comprises a plurality of side walls removable from each other and from the base.

11. The system of claim 1, further comprising a biocontainer in the second compartment.

12. The system of claim 11, further comprising a fluid inside the biocontainer.

13. The system of claim 12, further comprising ancillary equipment for the bio container stored in the first compartment.

14. The system of claim 13, wherein the ancillary equipment comprises tubing that passes through the opening in the inner wall to connect to the biocontainer.

15. The system of claim 13, wherein the ancillary equipment comprises a sterilized aseptic connector.

16. A system for aseptic storage or transportation of a fluid, comprising:

a rigid container including a first wall, a second wall, and a floor;

a cavity inside the container;

an inner wall dividing the cavity into a first compartment and a second compartment for receiving a biocontainer, with the first compartment between the first wall and the inner wall, and the second compartment between the inner wall and the second wall; and pivot means pivotably coupling the inner wall to the first wall.

17. A system for aseptic storage or transportation of a fluid, comprising:

a rigid container including a first wall, a second wall, and a floor;

a cavity inside the container;

an inner wall dividing the cavity into a first compartment and a second compartment for receiving a biocontainer, with the first compartment between the first wall and the inner wall, and the second compartment between the inner wall and the second wall; and a pivot joint connecting the inner wall to the first wall.

18. The system of claim 17, wherein the pivot joint comprises a pivot arm.

19. The system of claim 17, further comprising a second pivot joint connecting the inner wall to the first wall.

20. The system of claim 19, wherein the second pivot joint comprises a pivot arm.

21. The system of claim 20, wherein the pivot joint comprises a pivot arm.

22. The system of claim 1, wherein the inner wall is rotatable relative to the first wall between a first position generally transverse to the floor and a second position generally parallel to the floor.

23. The system of claim 16, wherein the inner wall is rotatable relative to the first wall between a second position generally transverse to the floor and a second position generally parallel to the floor.

24. The system of claim 17, wherein the inner wall is rotatable relative to the first wall between a second position generally transverse to the floor and a second position generally parallel to the floor.

25. The container of claim 4, wherein the first and second axes are generally parallel.

26. A container for aseptic storage or transportation of a fluid, comprising:

a base defining a floor;

a perimeter coupled to the base, wherein the floor and the perimeter wall define a cavity;

an inner wall dividing the cavity into first and second compartments, each compartment extending from the floor wherein the first compartment extends between the inner wall and a section of the perimeter wall; and a pivot joint coupled between the inner wall and the section of the perimeter wall, wherein the inner wall is rotatable with respect to the section of the perimeter wall about the pivot joint, wherein the inner wall is rotatable about said pivot joint about a first axis with respect to the base, wherein the section of the perimeter wall is rotatable about a second axis with respect to the base to a stowed position over the floor of the base, and wherein when in the stowed position, the inner wall and the section of the perimeter wall form a stack over the floor of the base.

* * * * *

UNITED STATES PATENT AND TRADEMARK OFFICE

CERTIFICATE OF CORRECTION

PATENT NO. : 8,844,753 B2
APPLICATION NO. : 13/425204
DATED : September 30, 2014
INVENTOR(S) : Christopher J. Starnes It is certified that error appears in the above-identified patent and that said Letters Patent is hereby corrected as shown below:

In the Claims

| | |
|---|---|
| Col. 9, line 21, Claim 13 | Delete "bio container", |
| | Insert --biocontainer-- |
| Col. 10, line 17, Claim 23 | Delete "between a second position", |
| | Insert --between a first position-- |
| Col. 10, line 21, Claim 24 | Delete "between a second position", |
| | Insert --between a first position-- |
| Col. 10, line 29, Claim 26 | Delete "perimeter coupled", |
| | Insert --perimeter wall coupled-- |

Signed and Sealed this
Twenty-sixth Day of July, 2016

Michelle K. Lee

Michelle K. Lee
*Director of the United States Patent and Trademark Office*